US005269697A

United States Patent [19]

Essex

[11] Patent Number: 5,269,697

[45] Date of Patent: Dec. 14, 1993

[54] METHOD TO MAKE SAFE AN UNGROUNDED ELECTRICAL RECEPTACLE AND APPARATUS THEREFOR

[76] Inventor: Frederick B. Essex, 31805 Pettibone Rd., Solon, Ohio 44139

[21] Appl. No.: 850,956

[22] Filed: Mar. 11, 1992

[51] Int. Cl.[5] ..... H01R 13/44

[52] U.S. Cl. ..... 439/148; 439/489; 439/135

[58] Field of Search ..... 439/135, 142, 148, 101, 439/488–491, 519, 521, 937; 174/66, 67

[56] References Cited

U.S. PATENT DOCUMENTS 1,726,166 8/1929 Sparks ..... 439/148
1,955,513 4/1934 Petersen ..... 439/489
4,806,112 2/1980 Roberts et al. ..... 439/148

FOREIGN PATENT DOCUMENTS 2372524 7/1978 France ..... 439/148

*Primary Examiner*—Paula A. Bradley
*Attorney, Agent, or Firm*—Donald A. Bergquist

[57] ABSTRACT

A method is taught whereby an ungrounded safety electrical receptacle or outlet is made incompatible with a three-pronged safety plug, thereby to warn the user that the receptacle is not grounded. The method employs various fillers to fill or otherwise block entry to the hole in the outlet that receives the grounding prong of the safety plug. Labelling of the receptacle employing the filler is included. The various fillers for use in the method are also claimed, as are labelling techniques.

13 Claims, 2 Drawing Sheets

METHOD TO MAKE SAFE AN UNGROUNDED ELECTRICAL RECEPTACLE AND APPARATUS THEREFOR

INTRODUCTION

This invention relates to electrical receptacles of the type commonly used in the United States in convenience outlets for standard 110-volt alternating electrical current in homes and industry. More specifically, this invention relates to replacing such a receptacle wherein the receptacle being replaced is ungrounded and where no grounding means is present in the electrical junction box into which a replacement receptacle is to be installed. This invention does not relate to providing such a grounding means, rather it relates to providing means whereby the receptacle is made incompatible with a three-prong plug, one prong of which is intended to contact a grounded connection in the receptacle.

The National Electrical Code mandates that all new and replacement 110-volt receptacles in both industrial and residential construction be of a type to receive a three-prong plug, the third prong being a grounding connection. The sole exception to this rule is in replacing a non-grounded (two-prong) receptacle where a ground connection is not available in the wiring supplying electricity to the junction box housing the receptacle. In the case of this sole exception, it is permissible to install a non-grounded (two-prong) replacement receptacle. It is never permissible to install a receptacle for a three-pronged plug if the receptacle is not properly grounded.

In past years, electricians had the option of purchasing receptacles for either two-pronged plugs or three-pronged plugs. Because only the receptacles for three-pronged plugs are allowed in new construction, the receptacles for two-pronged plugs have become rarely (if ever) available; it is not economically feasible for manufacturers to continue producing them and for distributors and retailers to continue stocking them. No alternative has been provided to the industry, so receptacles for three-pronged plugs are sometimes installed without a proper ground; once installed, they appear to the user to be grounded receptacles, thereby giving the user a false sense of security.

For purposes of this discussion, a receptacle for a three-pronged plug will be called a "safety receptacle". If a ground wire is installed, the term "grounded safety receptacle" will be used. If a ground wire is not installed, the term "ungrounded safety receptacle" will be used. An ungrounded safety receptacle that has been altered according to the teachings of this invention will be referred to as a "modified ungrounded safety receptacle". A three-pronged plug for use with a safety receptacle will be referred to as a "safety plug". For purposes of the claims of this invention, to differentiate the claims from claims directed to receptacles as containers, the commonly-used term "outlet" is substituted for "receptacle", although receptacle will be used throughout this description.

SUMMARY OF THE INVENTION

It is an object of this invention to provide a method for permanently altering a safety receptacle to create a receptacle suitable for use as a modified ungrounded safety receptacle that will prevent the use therein of a safety plug without the use of an adaptor, thereby alerting the user of the non-grounded nature of the modified ungrounded safety receptacle, wherein a filler is placed in the hole of said safety receptacle intended to receive the grounding prong of a safety plug.

It is an object of this invention to provide such a method wherein the filler placed in the hole intended to receive the grounding prong of a safety plug is not removable from said hole and thus is permanently installed.

It is an object of this invention to provide such a method wherein the filler placed in the hole intended to receive the grounding prong of a safety plug is installed in a liquid or semi-liquid state.

It is an object of this invention to provide such a method wherein the filler placed in the hole intended to receive the grounding prong of a safety plug is installed as a molten thermoplastic material.

It is an object of this invention to provide such a method wherein the filler placed in the hole intended to receive the grounding prong of a safety plug is installed as a substantially rigid member.

It is an object of this invention to provide such a method wherein the filler placed in the hole intended to receive the grounding prong of a safety plug is installed as a substantially rigid member having barbs to prevent its removal, once it is inserted.

It is an object of this invention to provide such a method wherein the filler placed in the hole intended to receive the grounding prong of a safety plug is installed as a substantially rigid member having a mechanically expandible portion, as a so-called "pop rivet".

It is an object of this invention to provide such a method wherein the filler placed in the hole intended to receive the grounding prong of a safety plug has a warning label on its exposed surface to alert users of an ungrounded safety receptacle.

It is an object of this invention to provide such a method wherein the filler placed in the hole intended to receive the grounding prong of a safety plug is brightly colored to alert users of an ungrounded safety receptacle.

It is an object of this invention to provide a filler for the hole in an ungrounded safety receptacle, which hole is provided to receive the grounding prong of a safety plug, wherein the filler permanently prevent the use therein of a safety plug without the use of an adaptor, thereby alerting the user of the non-grounded nature of the modified ungrounded safety receptacle.

It is an object of this invention to provide such a filler wherein the filler is not removable from said hole and thus is permanently installed.

It is an object of this invention to provide such a filler wherein the filler placed in the hole intended to receive the grounding prong of a safety plug is a substantially rigid member having barbs to prevent its removal, once it is inserted.

It is an object of this invention to provide such a filler wherein the filler placed in the hole intended to receive the grounding prong of a safety plug is installed as a substantially rigid member having a mechanically expandible portion, as a so-called "pop rivet".

It is an object of this invention to provide such a filler wherein the filler placed in the hole intended to receive the grounding prong of a safety plug has a warning label on its exposed surface to alert users of an ungrounded safety receptacle.

It is an object of this invention to provide such a filler wherein the filler placed in the hole intended to receive the grounding prong of a safety plug is brightly colored to alert users of an ungrounded safety receptacle.

DETAILED DESCRIPTION OF THE INVENTION

Figure 2:
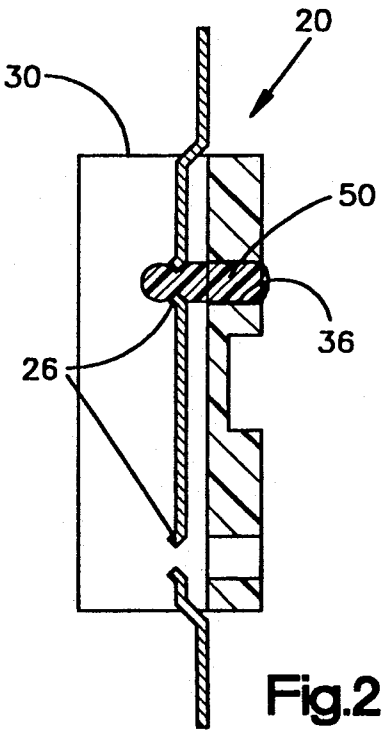
FIG. 2 illustrates, in cross section, a safety receptacle with a filler that has been installed in a liquid or semi-liquid state.

This invention will best be understood by referring to the drawings, wherein the same part is identified throughout by the same reference number.

Figure 1:
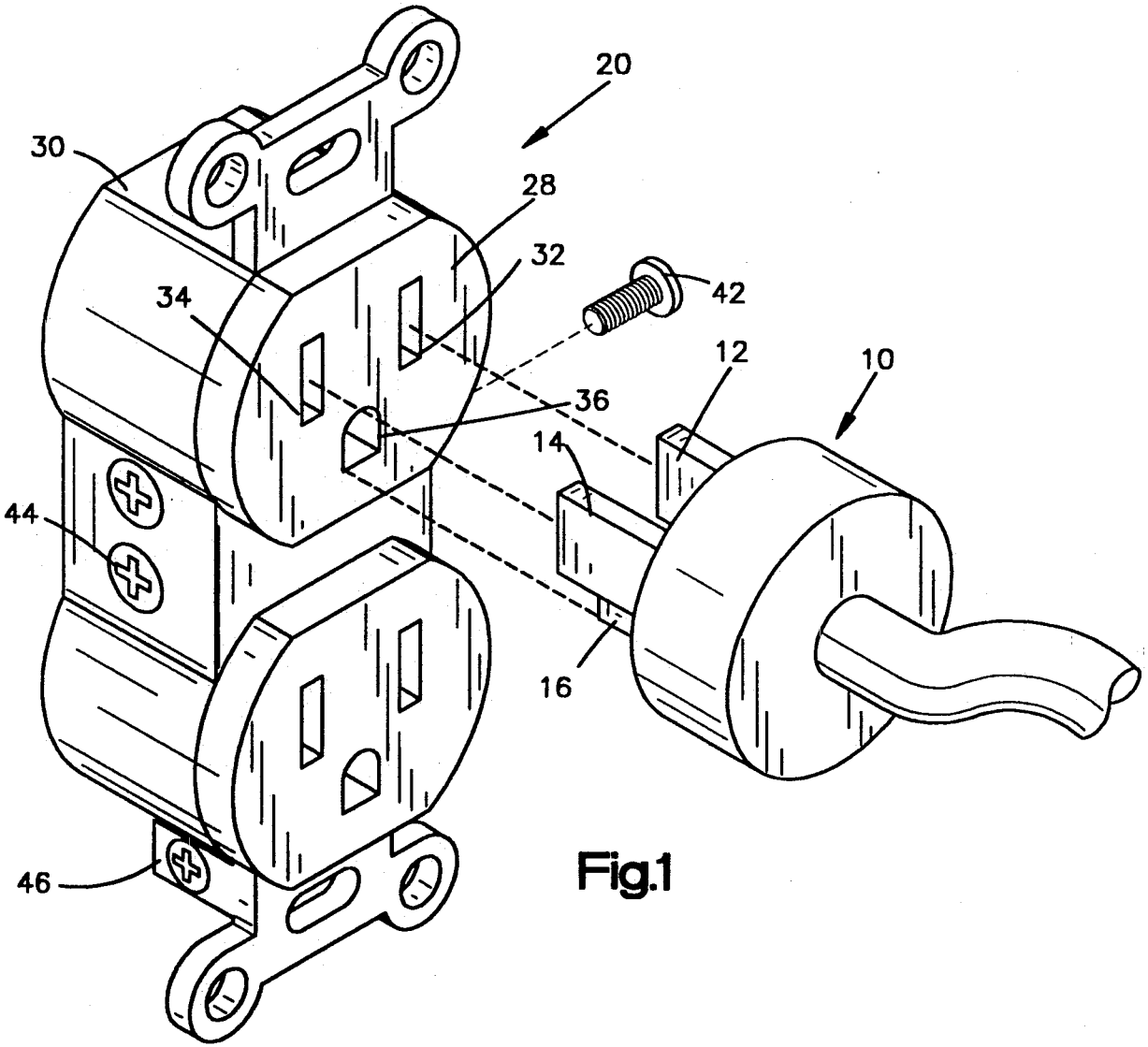
FIG. 1 illustrates a safety plug and a safety receptacle.

FIG. 1 illustrates a safety plug 10 and a safety receptacle 20. The purpose of this figure is to show the basic information of the prior art and to provide a basis for discussion of the present invention.

The safety plug 10 has three prongs: two prongs, 12 and 14, are provided to carry the electrical current for any appliance or load attached to the plug; the third prong 16 is a grounding connection for safety, usually connected by a separate wire to the chassis (or the case, or enclosure) of the appliance, to protect a user of the appliance from electrical shock hazzard should a defect exist in the electrical circuit, causing current to flow to the chassis. The grounding prong 16 is generally longer than the other two prongs to ensure grounding contact is attained before any electrical current can flow to the appliance.

The safety receptacle 20 has three contacts within a non-conductive body 30. These contacts are in register with respective holes 32 34 36 in the face 28 of the body of the receptacle and are in a pattern to receive the respective prongs 12 14 16 of the safety plug 10. Within the body 30, each of the contacts are connected to a respective terminal 42 44 46 for supplying electrical power to the receptacle 20 and thence to the plug 10 and thence to the appliance.

The present invention addresses the situation wherein the electrical wiring serving the location of the installed receptacle does not provide an adequate grounding connection for the proper grounding of the grounding contact within the body of the receptacle. To install a safety receptacle in such a situation creates an ungrounded safety receptacle in such a situation creates an ungrounded safety receptacle that may be falsely interpreted by a user (even at a much later time) as being a grounded safety receptacle, thereby creating a potentially hazzardous condition.

The basic invention here presented is a method for increasing the safety of an ungrounded safety receptacle by preventing the entry of the grounding prong of a safety plug into the modified ungrounded safety receptacle. Several methods for accomplishing this end are presented. In addition, several devices are presented for use in the respective methods to make each method completely workable.

The simplest method of preventing entry of a grounding prong into an ungrounded safety receptacle is to physically block the entry into the receptacle by installing a filler in the hole that receives the grounding prong. In the best mode, the filler is not removable by ordinary means.

FIG. 2 illustrates a portion of a safety receptacle with a filler 50 that has been installed in a liquid or semi-liquid state. Such a filler may be made from a semi-liquid epoxy cement, a silicone caulking compound, or a hot-melt material (i.e. thermoplastic) dispensed from a so-called "hot-melt glue gun," all of which are examples of materials that would gain rigidity upon curing or cooling. Such a material must be an electrical insulator, so that any flow of the material into contact with any other electrical elements within the body of the receptacle would not present a hazzard. The filler 50 would be non-removable by virtue of the flow of material within the body 30 of the receptacle 20 as well as its adhesion to internal surfaces of the body and to the electrical contacts 26 for the grounding prong within the body of the receptacle 20.

Figure 3:
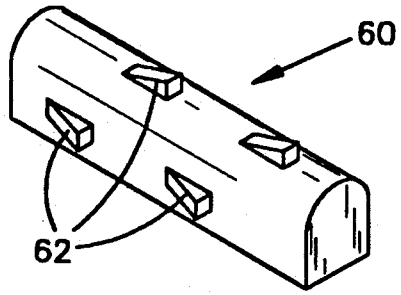
FIG. 3 illustrates a substantially rigid filler.

FIG. 3 illustrates a substantially rigid filler member 60 that is substantially in the shape of a grounding prong of a safety plug. This member may be used as a filler in the hole 36 that receives the grounding prong 16. In the simplest embodiment of this variation, the filler 60 is not removable by ordinary means merely by its inaccessability, it being recessed into the hole 36 and held in place by the grip of the electrical contacts 26 for the grounding prong within the body of the receptacle 20. Greater security may be attained by providing outwardly-directed barbs 62 along the length of the rigid filler member 60, thereby to allow movement of the member 60 into the hole 36, but not out of the hole.

Figure 4:
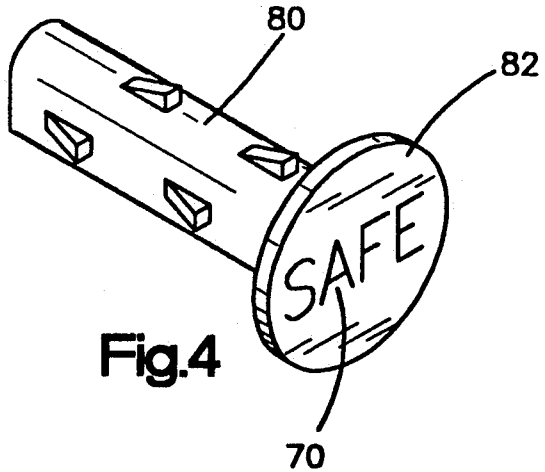
FIG. 4 illustrates a filler having a warning label.

As a means to further inform or alert the user of a receptacle that the receptacle is a modified ungrounded safety receptacle so that he can take proper precautions to properly ground any appliance he may be using, any of the fillers herein discussed may be brightly colored. Alternatively, or even in conjunction with the brightly-colored filler, a filler may be used in conjunction with a label that may be printed or embossed with cautionary indicia, either textural or symbolic. Shown in FIG. 4, such a label 70 could be a separate item or it could be made an integral part of the filler, as a flattened nail-head-like portion of a rigid filler 80, wherein the flattened portion 82 would be the label that would be immediately obvious on the face 28 of the body of the receptacle 20. For fillers installed in a semi-liquid state, such a nailhead label could be inserted before the filler has cured or cooled, thereby to permanently label the potential hazzard.

Yet another type of filler is one based upon a method for installing blind rivets using so-called "pop rivets". A pop rivet has a tubular structure having an expanded portion—a head—at one end. Through the tubular structure and extending through this head is a captive rod having an expanded portion at the end inserted into the tube. To install a pop rivet in a hole accessible only from the front, the rod is pulled relative to the head, thereby pulling the expanded portion from the tube; the expanded portion expands the tube as it moves. Ultimately, the expansion of the tube is restricted by the material surrounding the back side of the hole and additional pulling of the rod causes the rod to break off, leaving a secure rivet behind.

Figure 5:
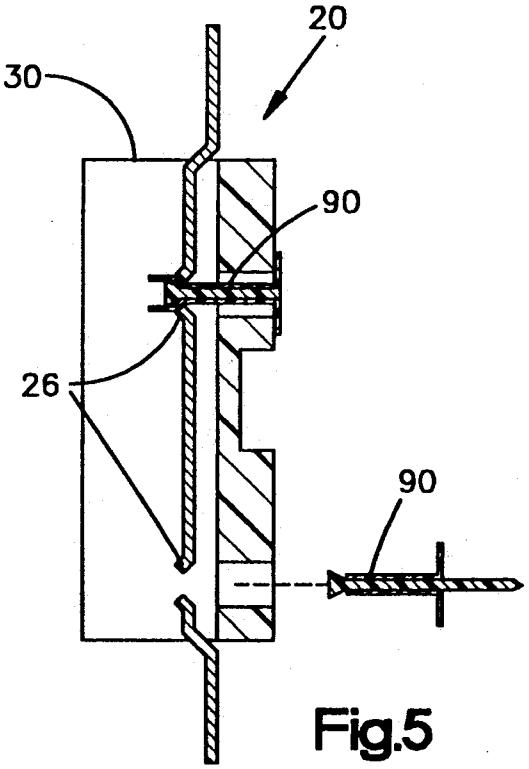
FIG. 5 shows a filler of the pop rivet variety.

FIG. 5 shows a filler 90 of the pop rivet variety. In this case, the rivet can be of metal because there is no electrical connection to it within the body of the receptacle. If connection were made to it, that connection would be a grounding connection.

As a corollary to the use of a pop rivet type of filler, such a filler could be factory installed to be removed by the installer when the receptacle is to be properly grounded. A tool for removing the filler by inserting a portion of the tool to punch out the residual expanded portion of the pop rivet rod might be provided. This approach would likely be unpopular because most installation would require removing the filler. It is more cost effective to install a filler in the few cases where it is needed.

Figure 6:
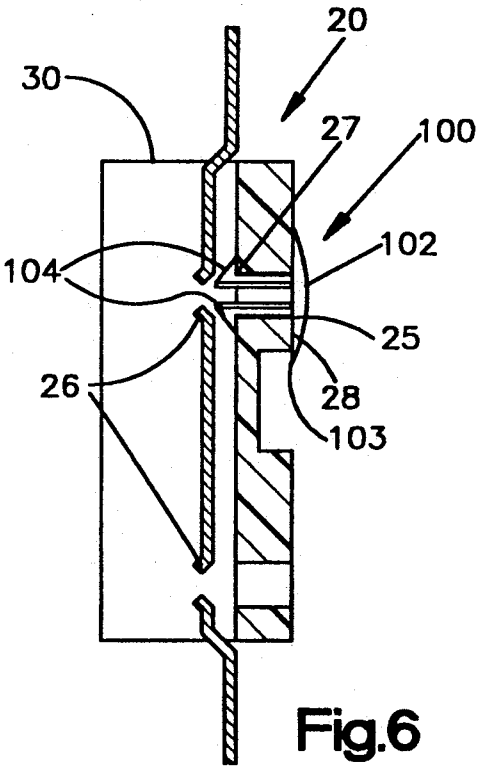
FIG. 6 illustrates a filler similar to parts of a snap fastener.

A filler need not fill the entire depth the grounding hole of the receptacle; it is sufficient for the filler to merely block the entrance to the hole. To this end, a filler similar to parts of a snap fastener could be used. Such a filler 100, shown in FIG. 6, would comprise a head 102 to cover the entrance 25 to the hole 26 and two or more prongs 104 to engage either the inner periphery 27 of the hole 36 of the receptacle 20 or the grounding contact 26 within the body. Such a filler 100 would be difficult to remove without a tool if the periphery 103 of the head 102 thereof were tapered to present a smooth edge and close fit with the face 28 of the receptacle.

Having thus described his invention, including totally functional specific examples thereof, applicant desires to include within the scope of his invention those improvements that would be immediately obvious to one skilled in the art, some, but not all of which have been referred to herein. Applicant desires the breadth of his invention to be limited only by the scope of the claims appended hereto.

I claim:

1. A method whereby a safety outlet comprising a hole for receiving a grounding prong of a safety plug may be made safe for installing without proper grounding, said method comprising permanently placing a non-removable filler into said hole, thereby preventing the insertion therein of a safety plug and alerting the user of the non-grounded nature of the ungrounded safety outlet while not inhibiting use of said outlet by using a two-pronged plug.

2. The method of claim 1 wherein said filler is installed as a substantially rigid member.

3. The method of claim 2 wherein said substantially rigid member comprises a mechanically expandible portion thereof that is expanded after said placing into said hole, thereby to lock said filler into place.

4. The method of claim 2 wherein said filler has a surface that remains exposed after said filler is installed and said exposed surface provides a warning label, thereby to alert users of an ungrounded safety outlet.

5. The method of claim 2 wherein said filler has a surface that remains exposed after said filler is installed and said exposed surface is brightly colored, thereby to alert users of an ungrounded safety outlet.

6. A method whereby a safety outlet comprising a hole for receiving a grounding prong of a safety plug may be made safe for installing without proper grounding, said method comprising placing a non-removable filler into said hole, thereby preventing the insertion therein of a safety plug and alerting the user of the non-grounded nature of the ungrounded safety outlet, wherein said filler is installed as a substantially rigid member and wherein said substantially rigid member has barbs to prevent its removal, once it is inserted.

7. A method whereby a safety outlet comprising a hole for receiving a grounding prong of a safety plug may be made safe for installing without proper grounding, said method comprising placing a non-removable filler into said hole, thereby preventing the insertion therein of a safety plug and alerting the user of the non-grounded nature of the ungrounded safety outlet, wherein said filler is installed in a liquid or semi-liquid state.

8. The method of claim 7 wherein said filler is installed as a molten thermoplastic material.

9. In a safety outlet comprising a separate hole for receiving a grounding prong of a safety plug and wherein said outlet is to be installed where a grounding wire is not available, a filler specifically adapted for inserting into said hole and to be non-removable therefrom, said filler for preventing the insertion therein of a safety plug, thereby alerting the user of the non-grounded nature of the ungrounded safety outlet, wherein said filler comprises a substantially rigid member having barbs to prevent its removal, once it is inserted.

10. In a safety outlet comprising a separate hole for receiving a grounding prong of a safety plug and wherein said outlet is to be installed where a grounding wire is not available, a filler specifically adapted for permanently inserting into said hole and to be non-removable therefrom, said filler for preventing the insertion therein of a safety plug, thereby alerting the user of the non-grounded nature of the ungrounded safety outlet while not inhibiting use of said outlet by using a two-pronged plug.

11. The filler of claim 10 wherein said filler comprises a substantially rigid member having a mechanically expandible portion thereof that is to be expanded after said placing into said hole, thereby to lock said filler into place.

12. The filler of claim 10 wherein said filler has a surface that remains exposed after said filler is installed and said exposed surface provides a warning label, thereby to alert users of an ungrounded safety outlet.

13. The filler of claim 10 wherein said filler has a surface that remains exposed after said filler is installed and said exposed surface is brightly colored, therby to alert users of an ungrounded safety outlet.

* * * * *